US010954745B2

(12) United States Patent
Yue et al.

(10) Patent No.: US 10,954,745 B2
(45) Date of Patent: Mar. 23, 2021

(54) PLUG ASSEMBLY

(71) Applicant: CNPC USA Corp., Houston, TX (US)

(72) Inventors: Jianpeng Yue, Sugar Land, TX (US); Anthony Tran, Kemah, TX (US); Yu Liu, Beijing (CN); Xiongwen Yang, Beijing (CN)

(73) Assignee: CNPC USA Corporation, Houston, TX (US)

( * ) Notice: Subject to any disclaimer, the term of this patent is extended or adjusted under 35 U.S.C. 154(b) by 0 days.

(21) Appl. No.: 16/502,963

(22) Filed: Jul. 3, 2019

(65) Prior Publication Data

US 2021/0002973 A1 Jan. 7, 2021

(51) Int. Cl.
*E21B 33/134* (2006.01)
*E21B 33/12* (2006.01)
*E21B 33/129* (2006.01)

(52) U.S. Cl.
CPC ..... *E21B 33/134* (2013.01); *E21B 33/1208* (2013.01); *E21B 33/129* (2013.01)

(58) Field of Classification Search
CPC ..... E21B 33/134; E21B 33/1208
USPC ..... 166/179
See application file for complete search history.

(56) References Cited

U.S. PATENT DOCUMENTS 6,712,153 B2 3/2004 Turley et al.
6,769,491 B2 8/2004 Zimmerman et al.
7,424,909 B2 9/2008 Roberts et al.
8,069,918 B2 12/2011 Zimmerman et al.
8,596,347 B2 12/2013 Valencia et al.
8,695,714 B2 4/2014 Xu et al.
9,810,035 B1 * 11/2017 Carr ..... E21B 23/065
9,845,658 B1 * 12/2017 Nish ..... E21B 33/1293
2018/0004501 A1 2/2018 Thornton et al.
2018/0038191 A1 * 2/2018 Davies ..... E21B 23/01
2019/0006317 A1 2/2019 Frazier
2020/0048981 A1 * 2/2020 Coon ..... E21B 33/128

FOREIGN PATENT DOCUMENTS

WO WO-2019032682 A1 * 2/2019 ..... E21B 33/12

* cited by examiner

*Primary Examiner* — Taras P Bemko
(74) *Attorney, Agent, or Firm* — Craft Chu PLLC; Andrew W. Chu

(57) ABSTRACT

A plug assembly includes a cone assembly, a sealing ring, a slip device of a plurality of blades, a plurality of spaces defined by adjacent blades, a plurality of support lugs, and a setting ring. The setting ring moves from a first setting distance relative to the cone assembly to a second setting distance closer to the cone assembly to radially expand the sealing ring, slip device, and spaces to install the plug assembly at the downhole location. The support lugs are aligned with the spaces to prevent extrusion of the sealing ring into the spaces and radially expand when the blades and spaces radially expand. The support lugs can be separate from each other, overlap, or interlock. The method of installation includes radially expanding the sealing ring, when the sealing ring is separated from the spaces formed by the blades of the slip device.

20 Claims, 10 Drawing Sheets

PLUG ASSEMBLY

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a downhole tool for isolating zones in a wellbore. Even more particularly, the present invention relates to a plug assembly with additional support for a sealing ring.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone. The production fluids can be delivered to the production zone and not the non-productive zone. An isolation valve creates a barrier between the two different zones. A ball member in the valve can be actuated to seal between the zones. A frac plug also creates a barrier between the two different zones. The frac plug has slips to dig into the walls of a wellbore, and a ball seat in an annular wedge. A frac ball is dropped into the wellbore to be placed in the ball seat in a sealing engagement to isolate the production zone and non-productive zone. There are specialized frac plugs, such as bridge plugs, with different components and corresponding different methods for installing the plugs in the wellbore.

The general mechanism for installing in a wellbore is disclosed in various patents and patent publications. U.S. Pat. No. 8,579,024, issued on 12 Nov. 2013, to Mailand et al., shows the basic cone and slip components to grip the walls of the wellbore. U.S. Pat. No. 8,695,714, issued on 15 Apr. 2014 to Xu et al, also describes an invention related to these basic components. US Publication No. 2016/0305215, published on 20 Oct. 2016 for Harris et al., (and granted as USP 100000991 on 19 Jun. 2018) discloses another frac plug as a simplified wedge/cone and slip.

The plug assemblies with fewer components are generally faster and easier to install and less expensive to manufacture. In contrast with prior art downhole tools, including bridge plugs disclosed by the Applicant in U.S. Pat. Nos. 9,121,253 and 9,121,254, there are no longer the redundancies to attach and seal against the wall of the wellbore. The plug assemblies with only basic components must incorporate on modifications to achieve the same reliability as the more complex prior art downhole tools.

It is an object of the present invention to provide a plug assembly for separating zones in a wellbore.

It is an object of the present invention to provide a plug assembly with sealing engagement to the wellbore by a sealing ring and support lugs for the sealing ring.

It is an object of the present invention to provide a plug assembly without extrusion of the sealing ring into the slip device.

It is another object of the present invention to provide a plug assembly without extrusion into spaces between individual slips or blades of the slip device.

It is another object of the present invention to provide a plug assembly with a radially extending support lugs for a sealing ring.

These and other objectives and advantages of the present invention will become apparent from a reading of the attached specification.

BRIEF SUMMARY OF THE INVENTION

The plug assembly isolates production zones from non-productive zones in a wellbore drilled into a rock formation. The sealing engagement to the wellbore must be reliable, and several plug systems have a mandrel, a sealing member, ring members to back up the sealing member, multiple cone assemblies, and multiple slip device. A plug assembly with fewer components has fewer redundancies to ensure the required reliability. Embodiments of the present invention include a plug assembly with only one cone assembly, one sealing ring, and one slip device. There is a plurality of support lugs to back up the sealing ring and a setting ring for installation of the plug device. These embodiments provide a simpler and cost-effective downhole tool with reliability required for performing oil and gas operations in the wellbore.

The embodiment of the cone assembly has a first cone end with a first cone diameter, a second cone end with a second cone diameter, and a conical outer surface being between the first cone end and the second cone end and having an assembly axis. The cone assembly is an annular wedge or cone aligned along the assembly axis. The first cone diameter is smaller than the second cone diameter so that the conical outer surface is tapered from the second cone end to the first cone end. The sealing ring is mounted around the cone assembly. The sealing ring is oriented coaxially along the assembly axis 26A and radially expands relative to the assembly axis.

Embodiments of the slip device include a slip device being comprised of a plurality of blades radially arranged around the conical outer surface and also oriented along the assembly axis. Each blade radially expands relative to the assembly axis, and a plurality of spaces is defined by the plurality of blades. Each space is defined by the area or slot between corresponding adjacent blades of the plurality of blades. The spaces radially expand relative to the assembly axis in coordination with the blades.

Embodiments of the present invention further include a plurality of support lugs being positioned between the slip device and the sealing ring. Each support lug can be comprised of an abutment portion and a gap portion. Each abutment portion is placed between the sealing ring and a corresponding blade, while each gap portion is placed between the sealing ring and a corresponding space defined by the corresponding blade.

The invention also includes a setting ring axially aligned with the slip device, the sealing ring, and the cone assembly on the assembly axis. The slip device is positioned between the setting ring and the plurality of support lugs. In some embodiments, the setting ring has a first setting ring end and a second setting ring end. The first setting ring end is in radial sliding engagement with corresponding blades relative to the assembly axis. The blades remain in abutment to the setting ring, even as the blades radially expand relative to the assembly axis. Each gap portion of a support lug separates a corresponding space from the sealing ring to prevent extrusion of the sealing ring into the space. Thus, reliability of the sealing ring in the sealing engagement to the wellbore is supported by the support lugs.

Embodiments of the present invention include the blades having cavities and inserts for a roughened outer surface for improved gripping of the walls of the wellbore.

Alternative embodiments of the support lugs include each support lug being comprised of the abutment portion, the gap portion and another abutment portion. Each support lug may be symmetrical with abutment portions on both sides of the gap portion, such as a triangular wedge. The another abutment portion is between the sealing ring and a corresponding adjacent blade. In other embodiments, the support lug is asymmetrical, and the another abutment portion is a flange that is between the sealing ring and the corresponding adjacent blade. In further embodiments, the another abutment portion is between the sealing ring and the abutment portion of an adjacent support lug as an interlock. The support lugs can overlap an adjacent support lug and an adjacent blade for this interlocked embodiment.

The method for installation in a wellbore is another embodiment of the present invention. The installation of the plug assembly describes the method of using the plug assembly. The plug assembly is prepared placing the setting ring in a first setting position. All components are at radial distances relative to the assembly axis with the setting ring in the first setting position. The plug assembly is deployed to the downhole location. The setting ring is moved from the first setting position to a second setting position, radially expanding the sealing ring, the support lugs, the blades of the slip device, and the spaces defined by the blades. The plug assembly is locked at the downhole location with the blade embedded or anchored in the walls of the wellbore at a second blade position related to a greater radial expansion relative to the assembly axis. Embodiments of the method include sealing each space with the corresponding support lug concurrent with the step of moving the setting ring.

DETAILED DESCRIPTION OF THE INVENTION

Figure 1:
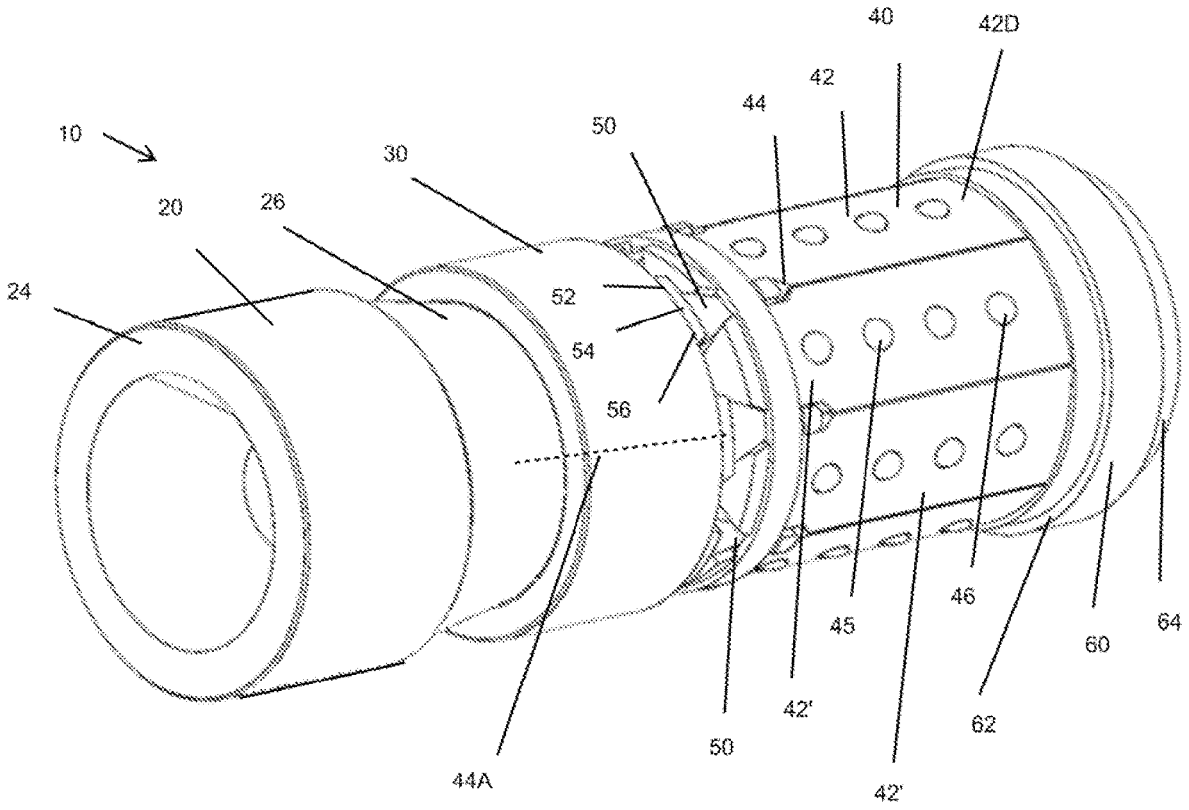
FIG. 1 is a perspective view of an embodiment of the plug assembly with support lugs, according to the present invention in the first setting position to be delivered to the downhole location.

Oil and gas operations include delivering drilling fluids to the wellbore and extracting the hydrocarbons from the wellbore. Isolation of the production zones within a rock formation allow the delivery or injection of drilling fluids to only those production zones and the pumping of the hydrocarbons out of those production zones only. The efficiency and reliability of the isolation and separation of the zones depend upon the sealing engagement of downhole tools to the wellbore. These downhole tools must be deployed into the wellbore and accurately installed at a downhole location. Prior art downhole tools, such as bridge plugs are comprised of a mandrel, a sealing member, ring members to back up the sealing member, multiple cone assemblies, and multiple slip device. Additionally, a proper setting tool to actuate and trigger all of those components must be able to reach the downhole location, perform the work to install the downhole tool, and leave the downhole location with the downhole tool in place. When a plug assembly with fewer components is used to isolate zones, the plug assembly is a simpler and less expensive downhole tool, and typically, a simpler setting tool can be deployed into the wellbore to install that simpler plug assembly. There are fewer redundancies to ensure the required reliability of the installation and sealing engagement to the wellbore for these types of plug assemblies.

Referring to FIGS. 1-6, the plug assembly 10 of the present invention is a downhole tool with fewer components. The plug assembly 10 has only one cone assembly 20, one sealing ring 30, and one slip device 40. The reliability of the sealing engagement to the wellbore for isolating zones is based on the sealing ring 30. The plug assembly 10 further includes a plurality of support lugs 50 to reinforce the seal created by the sealing ring 30. These embodiments provide a simpler and cost-effective downhole tool with reliability required for performing oil and gas operations in the wellbore.

Figure 2:
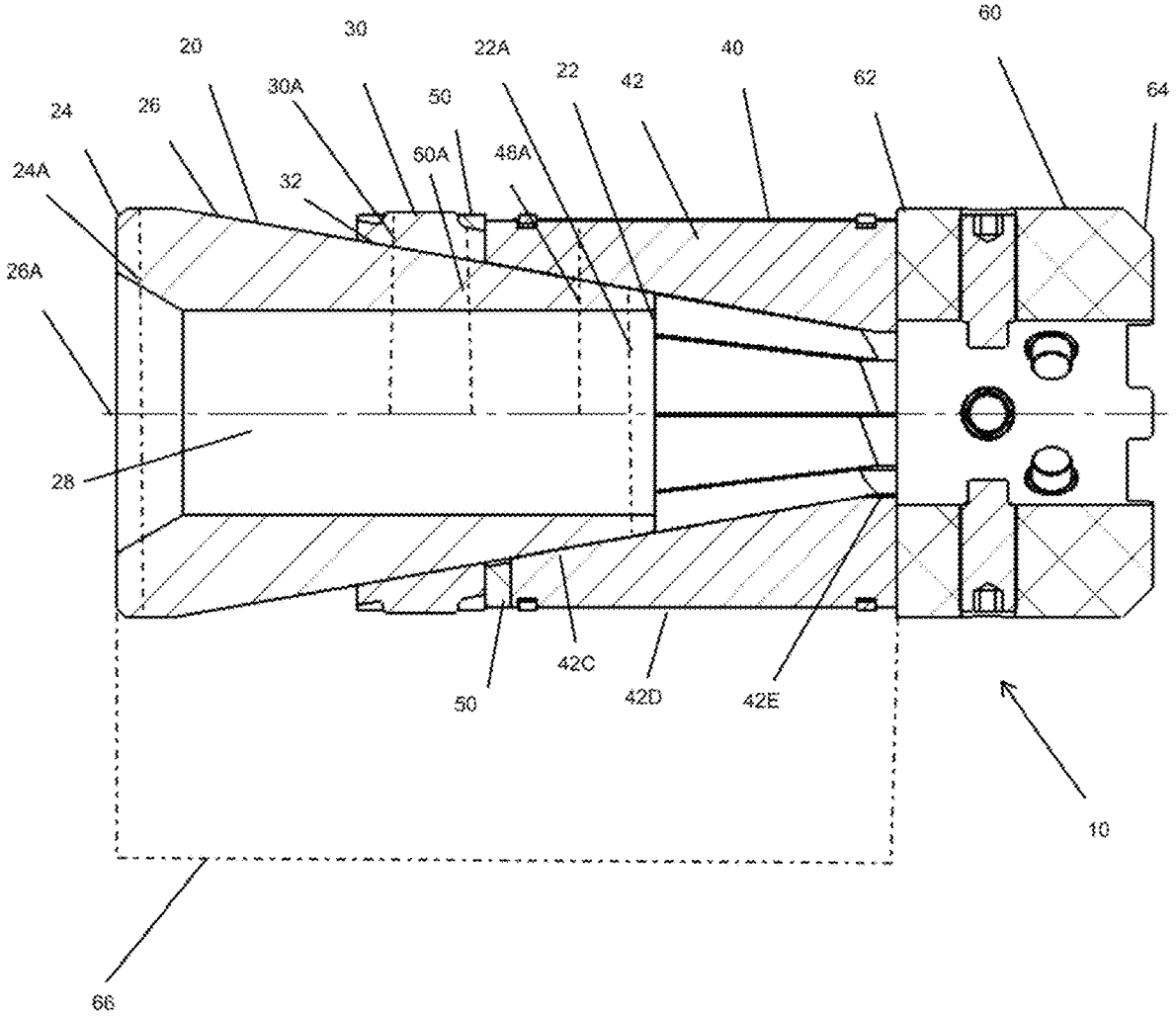
FIG. 2 is a side sectional view of an embodiment of the plug assembly with support lugs, according to the present invention in the first setting position.
Figure 5:
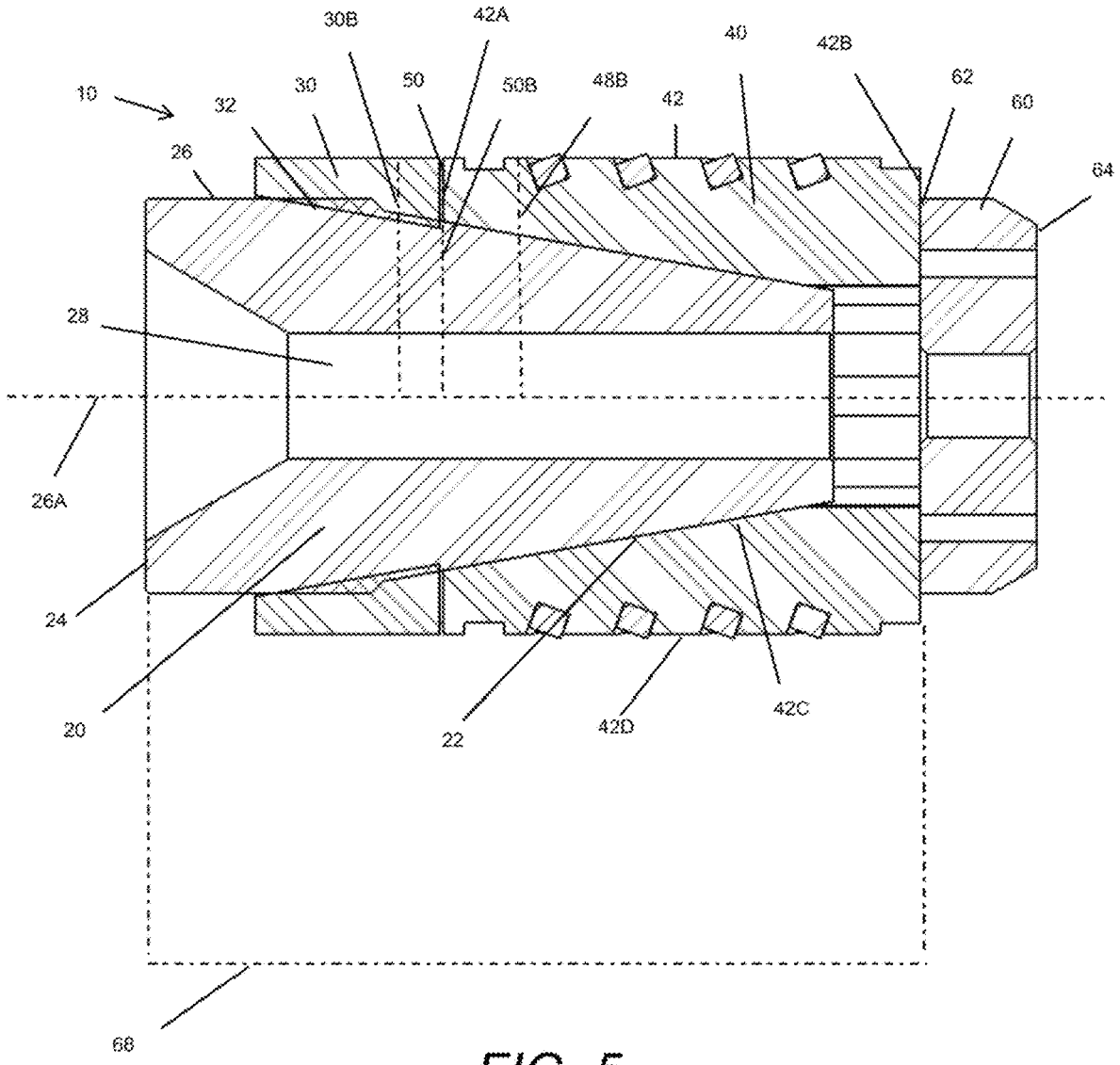
FIG. 5 is a side sectional view of an embodiment of the plug assembly with support lugs, according to the present invention in the second setting position.

Embodiments of the cone assembly 20 have a first cone end 22 with a first cone diameter 22A, a second cone end 24 with a second cone diameter 24A and a conical outer surface 26 being between the first cone end and the second cone end. The cone assembly 20 can have an annular wedge or cone shape with an assembly axis 26A. The assembly axis 26A is the centered axis through the cone assembly 20 that defines the flow path through the plug assembly 10. The flow path aligned on the assembly axis 26A is also the flow path to be blocked or sealed for isolation of zones. FIGS. 2 and 5 show that the first cone diameter 22A is smaller than the second cone diameter 24A. Thus, the conical outer surface 26 is tapered from the second cone end 24 to the first cone end 22 in terms of cone orientation.

FIGS. 1-6 also show an embodiment of the sealing ring 30 being mounted around the cone assembly 20 and along the assembly axis 26A. The sealing ring 30 is placed between the first cone end 22 and the second cone end 24 of the cone assembly 20. FIGS. 1-4 show that the sealing ring 30 is radially expandable relative to the assembly axis 26A. The sealing ring 30 can get larger around the assembly axis 26A.

The slip device 40 of the present invention can be comprised of a plurality of blades 42 radially arranged around the conical outer surface 26 and along the assembly axis 26A defined by the cone assembly 20. FIGS. 1-6 show each blade 42 having a first blade end 42A and a second blade end 42B opposite the first blade end. In the embodiment of FIGS. 1-6, each blade 42 can be comprised of an angled inner blade surface 42C and an outer blade surface 42D opposite the angled inner blade surface 42C.

Each angled inner blade surface 42C is in sliding engagement with the conical outer surface 26. As the cone assembly 20 moves closer, the conical outer surface 26A spreads the blades 42 further and further apart radially from the assembly axis 26A. Each blade 42 radially expands relative to the assembly axis 26A so that each blade 42 is further apart from adjacent blades 42.

In the present invention, the plurality of blades 42 define a plurality of spaces 44. Each space 44 is positioned between corresponding adjacent blades 42 of the plurality of blades 42. Each space 42 is also radially expandable relative to the assembly axis 26A. Each space 42 grows larger as corresponding blades 42 radially expand relative to the assembly axis 26A.

Figure 3:
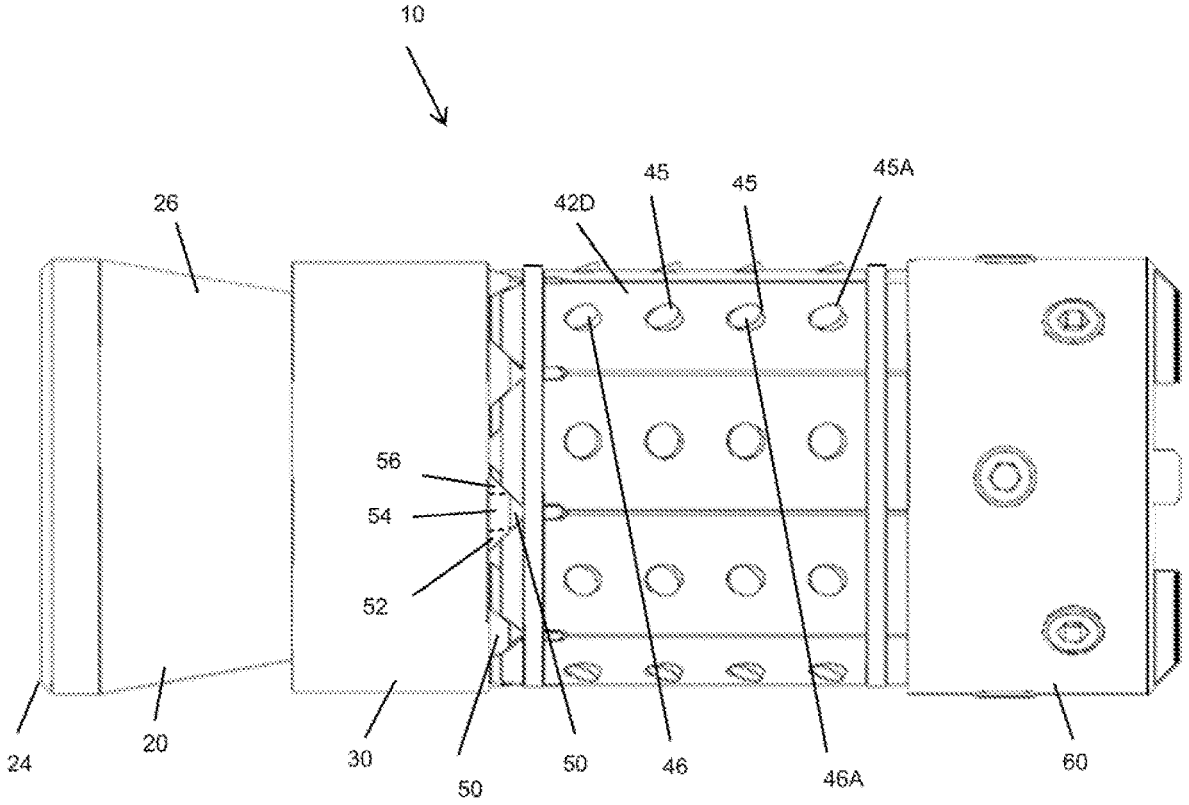
FIG. 3 is a side elevation view of an embodiment of the plug assembly with support lugs, according to the present invention in the first setting position.
Figure 4:
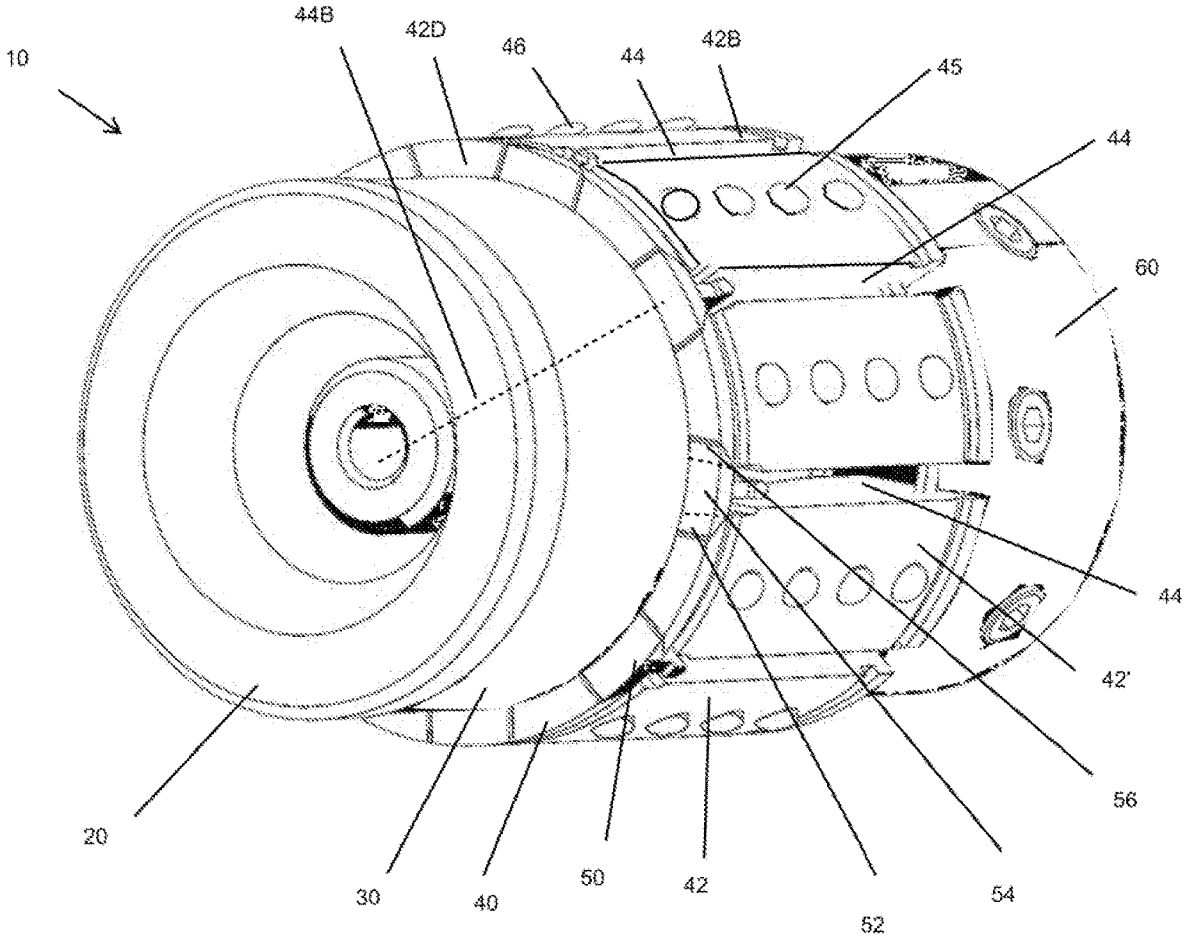
FIG. 4 is a perspective view of an embodiment of the plug assembly with support lugs, according to the present invention in the second setting position as installed at the downhole location.

FIGS. 1-6 also show a plurality of support lugs 50 being positioned between the slip device 40 and the sealing ring 30. Each support lug 50 is comprised of an abutment portion 52 and a gap portion 54. Each abutment portion 52 is placed between the sealing ring 30 and a corresponding first blade end 42A of a corresponding blade 42. FIGS. 1 and 4 show a triangular shoulder as the abutment portion 52 and the corresponding first blade ends 42A has a complementary angled surface. Each gap portion 54 is placed between the sealing ring 30 and a corresponding space 44 defined by the corresponding blade 42. FIGS. 1 and 4 show the gap portion 54 as an insert between blades 42. The insert is made integral with a triangular shoulder as the respective abutment portion 52. Each support lug 50 is also radially expandable relative to the assembly axis 26. As each space 44 grows larger as corresponding blades 42 radially expand, the gap portion 54 separates the sealing ring 30 from the space 44. The gap portion 54 prevents extrusion of the sealing ring 30 between the blades 42. The sealing ring 30 remains intact to seal the wellbore, and the support lugs 50 strengthen the seal formed by the sealing ring 30 against walls of the wellbore, as in FIGS. 3-4.

FIGS. 1-6 also show a setting ring 60 axially aligned with the slip device 40, the sealing ring 30, and the cone assembly 20 on the assembly axis 26A. The slip device 40 is placed between the setting ring 60 and the plurality of support lugs 50. FIGS. 1-6 shows the setting ring 60 having a first setting ring end 62 and a second setting ring end 64 opposite the first setting ring end 62. The first setting ring end 62 is in radial sliding engagement with corresponding second blade ends 42B of corresponding blades 42 of the slip device 40 relative to the assembly axis 26. That is, the blades 42 radial expand so that the second blade ends 42B slide against the first setting ring end 62. The setting ring 60 remains in abutment against the blades 42, even as the blades 42 radially expand. The setting ring 60 forces the slip device 40 to remain on the first setting ring end 62. The relationship between the second blade ends 42B and the first setting ring end 62 allows the positions of the cone assembly 20 and the setting ring 60 to control the radial expansion of the sealing ring 30, slip device 40, and the support lugs 50.

Figure 6:
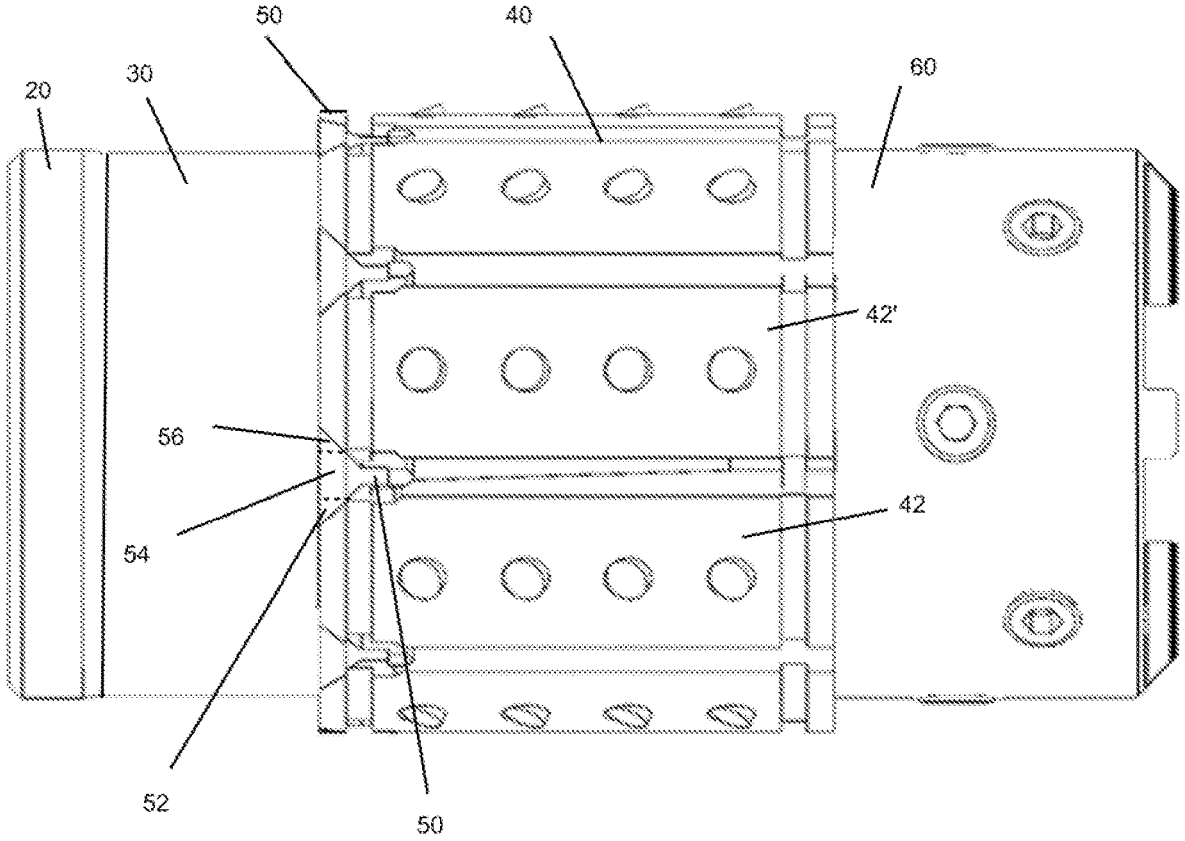
FIG. 6 is a side elevation view of an embodiment of the plug assembly with support lugs, according to the present invention in the second setting position.

FIGS. 1-3 show the setting ring 60 at a first setting distance 66 from the cone assembly 20 in a first setting ring position. FIGS. 4-6 show the setting ring 60 at a second setting distance 68 from the cone assembly 20 in a second setting ring position. The second setting distance 68 is less than the first setting distance 66. The first setting ring position corresponds to preparing the plug assembly 10 for deploying into the wellbore. The sealing ring 30, the slip device 40, and the support lugs 50 are in their closest positions to the assembly axis 26. The plug assembly 10 is thin for better mobility through the wellbore and lower risk of damage to the components. In both the first setting ring position and the second setting ring position, a respective gap portion 54 of at least one support lug 50 separates a corresponding space 44 from the sealing ring 30. The sealing ring 30 is sealed to each space 44 and cannot extrude into the spaces 44.

The sealing ring 30 has relationships to the cone assembly 20 to enable the separation of the sealing ring 30 from the spaces 44 defined by the blades 42 of the slip device 40. The sealing ring 30 is radially expandable. FIGS. 1-6 show that the sealing ring 30 has a first sealing ring diameter 30A relative to the assembly axis 26A at a first sealing position and a second sealing ring diameter 30B relative to the assembly axis 26A at a second sealing ring position. The first sealing position is between the first cone end 22 and the second cone end 24 of the cone assembly 20. The second sealing ring position is closer to the second cone end 24 than the first sealing ring position, and the second sealing ring diameter 30B is greater than the first sealing ring diameter 30A.

In FIGS. 1-6, the support lugs 50 are also radially expandable. Specifically, each support lug 50 has a first lug radius 50A relative to the assembly axis 26A at a first lug position and a second lug radius 50B relative to the assembly axis 26B at a second lug position. Each first lug position is radially closer to an adjacent support lug 50 than a corresponding second lug position. The second lug radius 50B is larger or further away from the assembly axis 26A than the first lug radius 50A.

Similarly, the blades 42 of the slip device 40 are radially expandable in coordination with the support lugs 50 and the sealing ring 30. Each blade 42 has a first blade radius 48A relative to the assembly axis 26A at a first blade position and a second blade radius 48B relative to the assembly axis 26A at a second blade position. Each first blade position is radially closer to an adjacent blade 42 than a corresponding second blade position. The second blade radius 48B is larger or further away from the assembly axis 26A than the first blade radius 48A.

In terms of the spaces 44 defined by the blades 42 of the slip device 40, the spaces are radially expandable as well. In particular, each space 44 has a first slot distance 44A relative to a corresponding adjacent blade 42 in the first blade position and a second slot distance 44B relative to the corresponding adjacent blade 42 in a respective second blade position. Each second slot distance 44B is also greater than a corresponding first slot distance 44A. Just as the blades 42 are further from each other and the assembly axis 26A, the spaces 44 are further from the assembly axis 26A and larger.

FIGS. 1-3 show the embodiment with the cone assembly 20 is in sliding engagement with the sealing ring 30 and the plurality of blades 42 towards the setting ring 60. The cone assembly 20 and the setting ring 60 are in the first setting distance 66 from each other. As such, the sealing ring 30 is in the first sealing position, each support lug 50 is in a respective first lug position, and each blade 42 is in a respective first blade position. The plug assembly 10 is shown in a radially condensed form. The spaces 44 may be very small between blades 42.

FIGS. 4-6 show the embodiment with the cone assembly 20 is in locked engagement with the sealing ring 30 and the plurality of blades 42 towards the setting ring 60. The cone assembly 20 and the setting ring 60 are in the second setting distance 68 from each other. As such, the sealing ring 30 is in the second sealing position, at least one support lug 50 is in a respective second lug position, and at least one blade 42 is in a respective second blade position. The spaces 44 are larger than the cone assembly 20 in sliding engagement with the sealing ring 30. The locked engagement matches the maximum radial expansion of the blades 42 so as to engage the walls of the wellbore. The upper limit for radial expansion is until the blades 42 of the slip device 40 engage the wellbore. The plug assembly 10 is installed at the downhole location when the cone assembly 20 is in locked engagement.

In some embodiments, the cone assembly 20 includes an inner cone passage 28. The inner cone passage 28 can fit a ball or a ball seat to create the barrier between zones. A barrier in the cone assembly 20 prevents fluid flow through the plug assembly 10, and the zones on each side of the plug assembly 10 are isolated. In some variations, the inner cone passage 28 is tapered itself so as to function as a ball seat. At least a portion of the inner cone passage 28 holds a means to form a barrier. The sealing ring 30, support lugs 50, and the blades 42 create the barrier around the plug assembly 10 in the wellbore, and the inner cone passage 28 can form the barrier through the plug assembly 10. Depending upon the complexity of the barrier for desired control of the tightness of the seal and the duration of the seal, different means to form a barrier are known in the prior art.

FIGS. 1 and 4 also show embodiments of the sealing ring 30 having a tapered inner surface 32 cooperative with the conical outer surface 26 of the cone assembly. There is full contact of the sealing ring 30 on the cone assembly 20 for the most sealing engagement between the components. There is sealing engagement along the entire tapered inner surface 32. There is sealing engagement between the sealing ring 30 and the wellbore in the locked engagement of the cone assembly 20 as well. The plug assembly 10 has the liquid tight seal so that fluid flow around the plug assembly 10 is not possible. All fluid flow through the plug assembly 10 must be controlled through the inner cone passage 28.

FIGS. 1-6 show embodiments of the blades 42. Each outer blade surface 42D can have a plurality of cavities 45 and a plurality of inserts 46. Each insert 46 protrudes from a corresponding cavity 45 so as to form a roughened outer surface 45A. The roughened outer surface 45A provides for improved gripping on the wall of the wellbore. The inserts 46 can dig into the wellbore for a more stable attachment. The plurality of cavities 45 and the plurality of inserts 46 can be arranged on each outer blade surface 42D from the first blade end 42A to the second blade end 42B. FIGS. 1 and 4 show each insert 46 having an oblique face 46A relative to a corresponding outer blade surface 42D. The oblique face 46A is angled radially outward from the corresponding outer blade surface 42D.

FIG. 2 shows an alternative embodiment of a blade 42 with a set inner blade surface 42E at the second blade end 42B and adjacent to the angled inner blade surface 42C. The entire inner blade surface does not have to be an angled inner blade surface 42C. It is possible to have a combination inner blade surface as an angled inner blade surface 42C and a set inner blade surface 42E. The abutment of the second blade ends 42B to the setting ring 60 are compatible with either embodiment of the inner blade surface.

FIGS. 1-6 show one embodiment of the support lugs 50 according to the present invention. Each support lug 50 is shown as further comprising another abutment portion 56 opposite the abutment portion 52 across a respective gap portion 54. In this embodiment, each support lug 50 overlaps both blades 42 and the space 44 between those blades 42. FIGS. 1-4 show the support lug 50 as a symmetrical triangular wedge. Ends of the triangular wedge are the abutment portion 52 and the another abutment portion 56, and the center insert is the gap portion 54.

Figure 7:
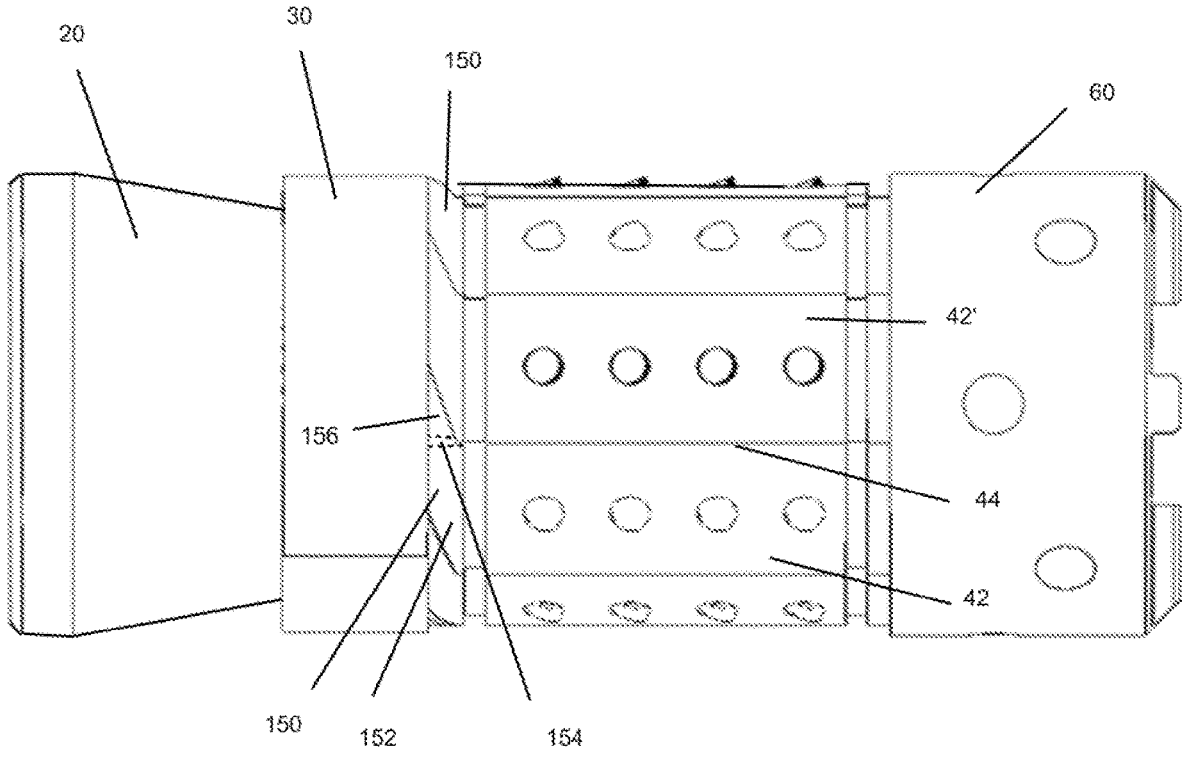
FIG. 7 is a side elevation view of another embodiment of the support lugs, according to the present invention in the first setting position.
Figure 8:
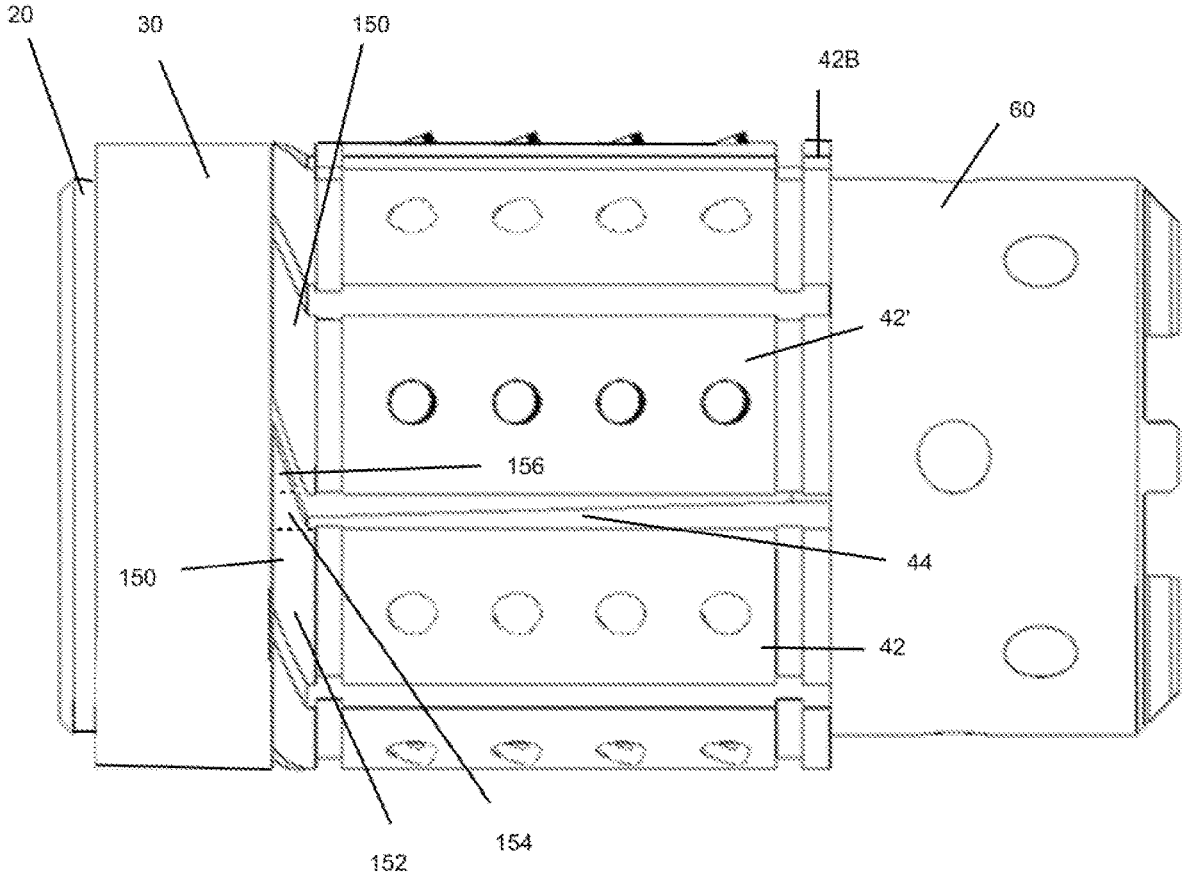
FIG. 8 is another side elevation view of the embodiment of the support lugs of FIG. 7, according to the present invention in the second setting position.

FIGS. 7-8 show an alternate embodiment of the support lug 150 with an abutment portion 152, a gap portion 154 and another abutment portion 156. The support lug 150 can be asymmetrical in FIGS. 5-6 with the abutment portion 152 fitted to the corresponding blade 42, and the gap portion 154 and another abutment portion 156 can be a flange member. The gap portion 154 corresponds to a portion of the flange member covering the space 44, and the another abutment portion 156 corresponds to a portion of the flange member between the sealing ring 30 and the corresponding adjacent blade 42.

Figure 9:
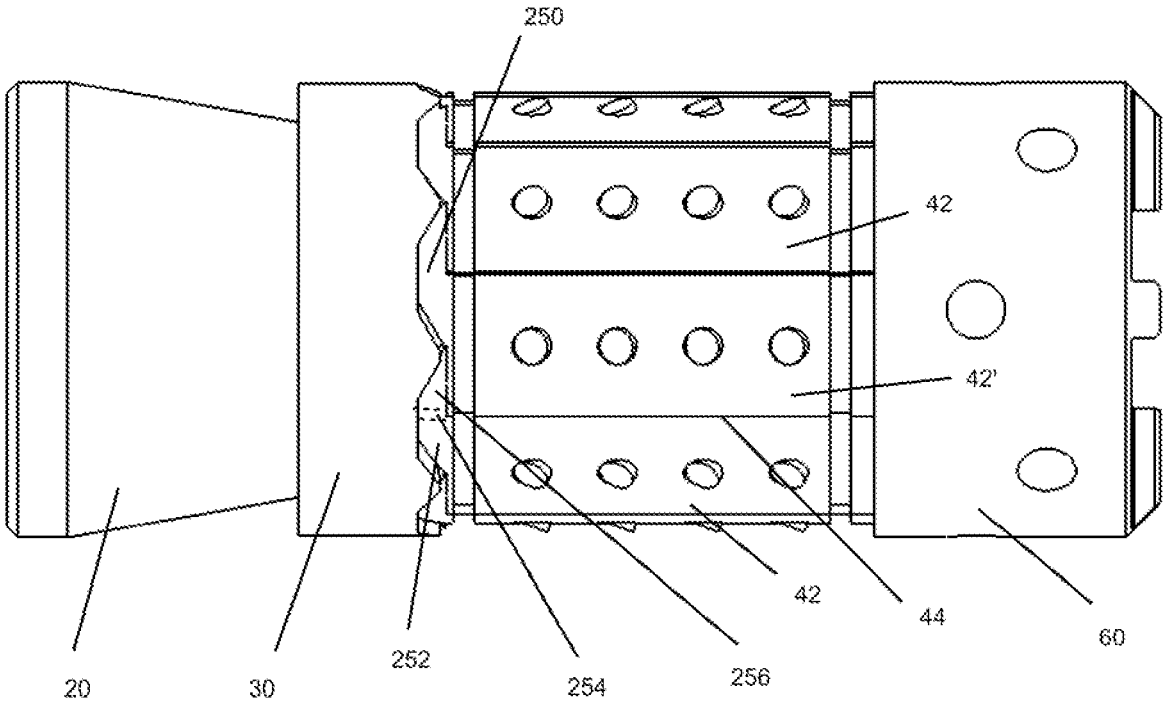
FIG. 9 is a side elevation view of still another embodiment of the support lugs, according to the present invention in the first setting position.
Figure 10:
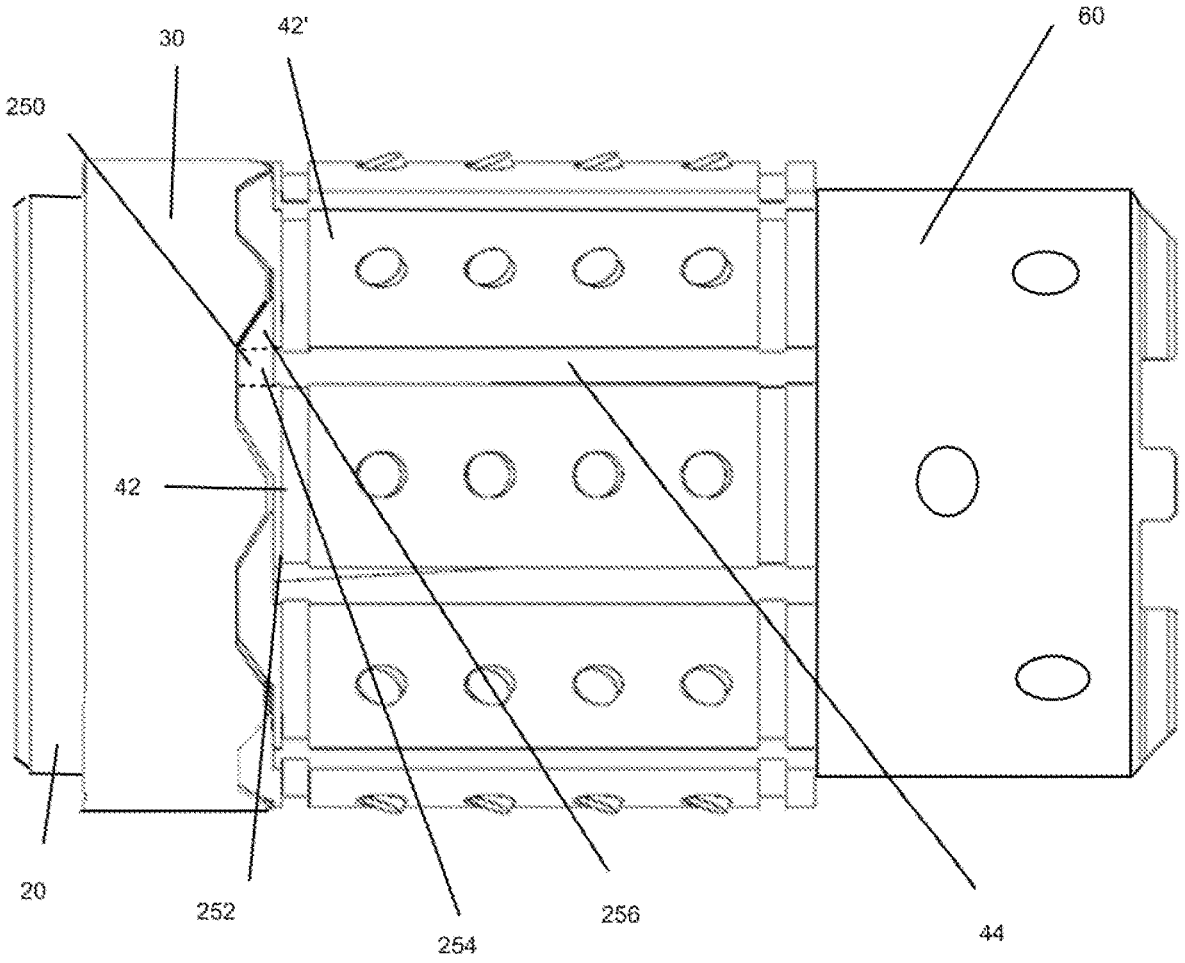
FIG. 10 is another side elevation view of the embodiment of the support lugs of FIG. 9, according to the present invention in the second setting position.

FIGS. 9-10 show still another alternate embodiment of the support lug 250 with an abutment portion 252, a gap portion 254, and another abutment portion 256. The support lug 250 can be interlocking with other support lugs 250. The abutment portion 252 is fitted to the corresponding blade 42, and the gap portion 254 and another abutment portion 256 can be an interlocking member. The gap portion 254 still covers the space 44, and the another abutment portion 256 is now between the sealing ring 30 and adjacent support lug 250 AND an adjacent blade 42. The space 44 is covered, and no seam to the space 44 is presented to the sealing ring 30. The support lugs 50, 150, 250 can overlap an adjacent blade 42 and/or an adjacent support lug for this interlocked embodiment.

The present invention also includes the method of using the plug assembly 10, in particular, a method for installing the plug assembly 10 to isolate zones in a wellbore. FIGS. 1 and 4, FIGS. 7 and 8, and FIGS. 9 and 10 show the steps of the method. First, the plug assembly 10 is prepared by placing the setting ring 60 at the first setting distance 66 relative to the cone assembly 20. The setting ring 60 is in the first setting position with the sealing ring 30, support lugs 50, and blades 42 of the slip device 40 at the closest to the assembly axis 26A. Then, the plug assembly 10 is deployed to a downhole location. The components in the compacted configuration are easier to navigate the wellbore. At the downhole location, the method includes moving the setting ring 60 from the first setting distance 66 to the second setting distance 68 so as to place the setting ring 60 in the second setting position. In addition to moving, the method includes radially expanding the sealing ring 30 from a first sealing ring diameter 30A relative to the assembly axis 26A to a second sealing ring diameter 30B relative to the assembly axis 26A, radially expanding the support lugs 50 from a first lug radius 50A relative to the assembly axis 26A at a first lug position to a second lug radius 50B relative to the assembly axis 26A at a second lug position, and radially expanding blades 42 of the slip device 40 from a first blade radius 48A relative to the assembly axis 26A at a first blade position to a second blade radius 48B relative to the assembly axis 26A to a second blade position. The second sealing ring diameter 30B is greater than the first sealing ring diameter 30A, the first lug position is closer to an adjacent support lug 50 than the second lug position, and the first blade position is closer to an adjacent blade 42 than the second blade position. The plug assembly 10 is now widening and getting thicker as the setting ring 60 moves to the second setting position.

Additionally, the method includes radially expanding each space 44 from a first slot distance 44A relative to a corresponding adjacent blade 42 in the first blade position to a second slot distance 44B relative to the corresponding adjacent blade 44 in a respective second blade position. The second slot distance 44B is greater than the first slot distance 44A so that the spaces 44 match the radial expanding of the blades 42 and sealing ring 30. The spaces 44 remain sealed from the sealing ring 30 by the support lugs 50 so that the radial expansion of the sealing ring 30 does not result in extrusion through the blades 42 of the slip device 40. Embodiments of the method also include the step of locking the plug assembly 10 at the downhole location with the slip device 40 having blades 2 in the second blade position. The widest radial expansion corresponds to the blades 42 attaching to the walls of the wellbore. That widest radial expansion is the second blade radius 48B with each blade 42. After locking the sealing ring 30 forms the liquid tight seal around the plug assembly 10, and the only fluid flow through the plug assembly is through the cone assembly 20 and other components aligned on the assembly axis 26. The plug assembly 10 is now installed and ready for oil and gas operations. The plug assembly 10 can be opened or closed to fluid flow through the plug assembly 10.

Embodiments of the method can further include deploying a setting tool to the downhole location and completing the step of moving the setting ring 60 with the setting tool. Setting tools must be compatible with being transported through the wellbore and can have varying degrees of complexity. In the present invention, a simpler setting tool can be used.

The present invention can include the step of sealing the sealing ring 30 from the space 44 with the support lug 50 concurrent with the step of moving the setting ring 60. The support lugs 50 block the sealing ring 30 from extruding into the spaces 44 so that the sealing ring 30 reliable seals to the wellbore. The support lugs 50 seal the spaces 44 to the sealing ring 30. Even during the steps of radially expanding the sealing ring 30, the support lugs 50, the blades 42 of the slip device 40, and the spaces 44 between adjacent blades 42, the support lugs 50 prevent the extrusion of the sealing ring 30.

The downhole location is comprised of a wellbore having a wellbore wall. The second setting distance 68 and the second setting position are determined by the blades 42 in the second blade position in fixed engagement with the wellbore wall. The wellbore wall determines the amount of radial expansions.

The present invention provides a plug assembly for separating zones in a wellbore. There is a seal between the plug assembly and the wellbore by the sealing ring. This seal enables fluid flow to be controlled through the plug assembly. This seal around the plug assembly is now supported by the support lugs as a quick and efficient back up to the sealing ring. Without the sealing member and rings members on both sides off the sealing member of the prior art, the present invention prevents extrusion of the sealing ring into the slip device with fewer components in more strategic arrangements in the plug assembly. The spaces between the blades are dynamic. The spaces change, so another sealing ring or just another sealing ring will have the same problems of extrusion as the original sealing ring. The present invention provides a structural component that interacts differently with the spaces, even when the spaces change. Embodiments of the present invention include overlapping, symmetrical, asymmetrical, and interlocking support lugs with the same interactions between the spaces and the sealing ring. The radial expansion of the sealing ring and the radial expansion of the support lugs reliably prevent extrusion and strengthen the seal of the sealing ring to the wellbore.

The foregoing disclosure and description of the invention is illustrative and explanatory thereof. Various changes in the details of the illustrated structures, construction and method can be made without departing from the true spirit of the invention.

We claim:

1. A plug assembly, comprising:

a cone assembly having a first cone end with a first cone diameter, a second cone end with a second cone diameter and a conical outer surface being between said first cone end and said second cone end and having an assembly axis, said first cone diameter being smaller than said second cone diameter, said conical outer surface being tapered from said second cone end to said first cone end;

a sealing ring being mounted around said cone assembly, along said assembly axis and between said first cone end and said second cone end of said cone assembly, said sealing ring being radially expandable relative to said assembly axis;

a slip device being comprised of a plurality of blades radially arranged around said conical outer surface and along said assembly axis, each blade having a first blade end and a second blade end opposite said first blade end, each blade being comprised of an angled inner blade surface and an outer blade surface opposite said angled inner blade surface, each angled inner blade surface being in sliding engagement with said conical outer surface, each blade being radially expandable relative to said assembly axis;

a plurality of spaces defined by said plurality of blades, each space being between corresponding adjacent blades of said plurality of blades, each space being radially expandable relative to said assembly axis;

a plurality of support lugs being positioned between said slip device and said sealing ring, each support lug being comprised of an abutment portion and a gap portion, each abutment portion being between said sealing ring and a corresponding first blade end of a corresponding blade, each gap portion being between said sealing ring and a corresponding space defined by said corresponding blade, each support lug being radially expandable relative to said assembly axis; and a setting ring being axially aligned with said slip device, said sealing ring, and said cone assembly on said assembly axis, said slip device being between said setting ring and said plurality of support lugs, said setting ring having a first setting ring end and a second setting ring end opposite said first setting ring end, said first setting ring end being in radial sliding engagement with corresponding second blade ends of corresponding blades of said slip device relative to said assembly axis, wherein said setting ring has a first setting distance from said cone assembly in a first setting ring position, wherein said setting ring has a second setting distance from said cone assembly in a second setting ring position, wherein said second setting distance is less than said first setting distance, wherein a respective gap portion of at least one support lug separates a corresponding space from said sealing ring, wherein a respective abutment portion of at least one support lug is positioned adjacent to said sealing ring with said setting ring at said first setting distance and at said second setting distance, and wherein said respective abutment portion of at least one support lug is positioned between said sealing ring and said corresponding first blade with said setting ring at said first setting distance and at said second setting distance.

2. The plug assembly, according to claim 1, wherein said sealing ring has a first sealing ring diameter relative to said assembly axis at a first sealing position, said first sealing position being between said first cone end and said second cone end of said cone assembly, wherein said sealing ring has a second sealing ring diameter relative to said assembly axis at a second sealing ring position, said second sealing ring position being closer to said second cone end than said first sealing ring position, and wherein said second sealing ring diameter is greater than said first sealing ring diameter.

3. The plug assembly, according to claim 2, wherein each support lug has a first lug radius relative to said assembly axis at a first lug position, and wherein each support lug has a second lug radius relative to said assembly axis at a second lug position, each first lug position being radially closer to an adjacent support lug than a corresponding second lug position.

4. The plug assembly, according to claim 3, wherein each blade has a first blade radius relative to said assembly axis at a first blade position, and wherein each blade has a second blade radius relative to said assembly axis at a second blade position, each first blade position being radially closer to an adjacent blade than a corresponding second blade position.

5. The plug assembly, according to claim 4, wherein each space has a first slot distance relative to a corresponding adjacent blade in said first blade position, and wherein each space has a second slot distance relative to said corresponding adjacent blade in a respective second blade position, each second slot distance being greater than a corresponding first slot distance.

6. The plug assembly, according to claim 5, wherein said cone assembly is in sliding engagement with said sealing ring and said plurality of blades towards said setting ring, said sealing ring being in said first sealing position, each support lug being in a respective first lug position, each blade being in a respective first blade position.

7. The plug assembly, according to claim 5, wherein said cone assembly is in locked engagement with said sealing ring and said plurality of blades, said sealing ring being in said second sealing position, at least one support lug being in a respective second lug position, at least one blade being in a respective second blade position.

8. The plug assembly, according to claim 1, wherein said cone assembly is further comprised of an inner cone passage.

9. The plug assembly, according to claim 1, said sealing ring having a tapered inner surface cooperative with said conical outer surface of said cone assembly.

10. The plug assembly, according to claim 1, wherein each outer blade surface comprises a plurality of cavities and a plurality of inserts, each insert protruding from a corresponding cavity so as to form a roughened outer surface.

11. The plug assembly, according to claim 10, said plurality of cavities and said plurality of inserts being arranged on each outer blade surface from said first blade end to said second blade end.

12. The plug assembly, according to claim 11, wherein each insert has an oblique face relative to a corresponding outer blade surface, each oblique face being angled radially outward from said corresponding outer blade surface.

13. The plug assembly, according to claim 1, wherein each blade is further comprised of a set inner blade surface at said second blade end and adjacent to said angled inner blade surface.

14. The plug assembly, according to claim 1, where each support lug further comprises another abutment portion opposite said abutment portion across a respective gap portion.

15. The plug assembly, according to claim 14, said another abutment portion being between said sealing ring and a corresponding first blade end of an adjacent blade, wherein said respective abutment portion is positioned between said sealing ring and said corresponding first blade end of said adjacent blade with said setting ring at said first setting distance and at said second setting distance.

16. The plug assembly, according to claim 15, said another abutment portion being between said sealing ring, a corresponding first blade end of an adjacent blade, and a respective abutment portion of a respective support lug of said adjacent blade.

17. A method for installation in a wellbore, the method comprising:

preparing said plug assembly, according to claim 1, the step of preparing being comprised of:

placing said setting ring at said first setting distance relative to said cone assembly, said setting ring being in said first setting position;

deploying said plug assembly to a downhole location;

moving said setting ring from said first setting distance to said second setting distance so as to place said setting ring in said second setting position;

radially expanding said sealing ring from a first sealing ring diameter relative to said assembly axis to a second sealing ring diameter relative to said assembly axis, said second sealing ring diameter being greater than said first sealing ring diameter;

radially expanding at least one support lug from a first lug radius relative to said assembly axis at a first lug position to a second lug radius relative to said assembly axis at a second lug position, said first lug position being closer to an adjacent support lug than said second lug position;

radially expanding at least one blade of said slip device from a first blade radius relative to said assembly axis at a first blade position to a second blade radius relative to said assembly axis to a second blade position, said first blade position being closer to an adjacent blade than said second blade position;

radially expanding at least one space from a first slot distance relative to a corresponding adjacent blade in said first blade position to a second slot distance relative to said corresponding adjacent blade in a respective second blade position, said second slot distance being greater than said first slot distance; and locking said plug assembly at said downhole location with said slip device having said at least one blade in said second blade position.

18. The method for installation, according to claim 17, further comprising the steps of:

deploying a setting tool to said downhole location; and completing the step of moving said setting ring with said setting tool.

19. The method for installation, according to claim 17, further comprising the steps of:

sealing said sealing ring from said at least one space with said at least one support lug concurrent with the step of moving said setting ring.

20. The method for installation, according to claim 17, wherein said downhole location is comprised of a wellbore having a wellbore wall, and wherein said second setting distance and said second setting position are determined by said at least one blade in said second blade position in fixed engagement with said wellbore wall.

* * * * *